US007718906B2

(12) United States Patent
Au et al.

(10) Patent No.: US 7,718,906 B2
(45) **Date of Patent: *May 18, 2010**

(54) HAND-HELD DEVICES WITH TOUCH SENSING ON/OFF OPERATION

(75) Inventors: Ka Hung Au, Kowloon (HK); Wing Kit Lui, Kowloon (HK)

(73) Assignee: Eric Beare Associates Ltd., Kowloon (HK)

( * ) Notice: Subject to any disclaimer, the term of this patent is extended or adjusted under 35 U.S.C. 154(b) by 1107 days.

This patent is subject to a terminal disclaimer.

(21) Appl. No.: 11/252,413

(22) Filed: Oct. 18, 2005

(65) Prior Publication Data

US 2006/0256087 A1 Nov. 16, 2006

Related U.S. Application Data

(63) Continuation-in-part of application No. 11/127,475, filed on May 12, 2005, now Pat. No. 7,185,999.

(51) Int. Cl.
*H01H 3/14* (2006.01)

(52) U.S. Cl. ..... 200/52 R; 200/600; 362/157; 362/205

(58) Field of Classification Search ..... 362/157, 362/205, 206, 295, 394, 395; 200/600
See application file for complete search history.

(56) References Cited

U.S. PATENT DOCUMENTS

| | | | | |
|---|---|---|---|---|
| 4,885,666 A | | 12/1989 | Yu | |
| 5,205,637 A | | 4/1993 | Caspari | |
| 5,450,299 A | * | 9/1995 | Lepre | 362/145 |
| 5,634,710 A | * | 6/1997 | Di Russo et al. | 362/100 |
| 6,388,390 B2 | | 5/2002 | Rachwal | |
| D522,743 S | | 6/2006 | Lui | |
| D539,433 S | | 3/2007 | Lui | |
| D539,481 S | | 3/2007 | Lui | |
| D566,312 S | | 4/2008 | Lui | |
| D577,115 S | | 9/2008 | Lui | |

FOREIGN PATENT DOCUMENTS

| | | |
|---|---|---|
| DE | 20 2005 008 579.0 | 8/2005 |
| EM | 000438791-0001 | 8/2005 |
| EM | 000438791-0002 | 8/2005 |
| EM | 000438791-0003 | 8/2005 |
| EM | 000438791-0004 | 8/2005 |
| GB | 2039355 A | 12/1979 |
| GB | 2039355 A | 8/1980 |

* cited by examiner

*Primary Examiner*—Kyung Lee
(74) *Attorney, Agent, or Firm*—Kenneth H. Ohriner; Perkins Coie LLP

(57) ABSTRACT

A hand-held battery powered device senses when it is picked up, and then automatically turns on. When the device is released or set back down, it automatically turns off. Touch or contact sensors sense the touch of a human hand, causing a circuit in the device to switch on a light source, such as an LED, or a motor, or other load. The device is advantageously designed so that when grasped or picked up, the fingers of the user's hand lay over touch sensors. Various types of touch sensors may be used. The touch sensors operate electrically, and without any movement, or moving parts.

18 Claims, 9 Drawing Sheets

HAND-HELD DEVICES WITH TOUCH SENSING ON/OFF OPERATION

This Application is a Continuation-in-Part of U.S. patent application Ser. No. 11/127,475, filed May 12, 2005, now U.S. Pat. No. 7,185,999, and incorporated herein by reference.

BACKGROUND

Hand-held electrical and electronic appliances and similar devices typically have an external switch used to turn the device on and off. Various switches have been used on these types of devices, including push-button switches, sliding switches, twist-on/twist-off switches, dial switches, and many others. These switches are generally mechanically actuated by the user's finger or thumb. However, switch actuation is necessary to turn the device on or off. This can result in difficulty and/or delay, especially in dark conditions, where the switch cannot be seen, and when the user is not familiar with the design of the device.

Some types of hand-held electrically powered devices, such as flashlights, have been designed with switches that automatically turn the flashlight on when the flashlight is removed from a charger, wall socket, or other location. Alternatively, some flashlights and other devices automatically switch on when immersed in water, or when moved into a specific vertical or horizontal position, or when some other event occurs. While these automatic-on designs avoid the need for manually switching the device on, they can also result in premature and inadvertent battery depletion.

Accordingly, there is a need for improved electrically powered hand-held devices.

BRIEF STATEMENT

A new electrically powered device or appliance senses when it is picked up, and then automatically turns on. When the device is released or set back down, it automatically turns off. In one aspect, the device may have touch or contact sensors that can sense the touch of a human hand. The device is advantageously designed so that when grasped or picked up, the fingers of the user's hand lay over touch sensors, causing the device to turn on. Various types of touch sensors may be used. The touch sensors may operate purely electrically, and without any movement, or moving parts.

The features described in one embodiment may also be used in the other embodiments. The invention resides as well in sub-combinations of the elements shown and described.

BRIEF DESCRIPTION OF THE DRAWINGS

In the drawings, wherein the same element number indicates the same element, in each of the views.

DETAILED DESCRIPTION

Figure 1:
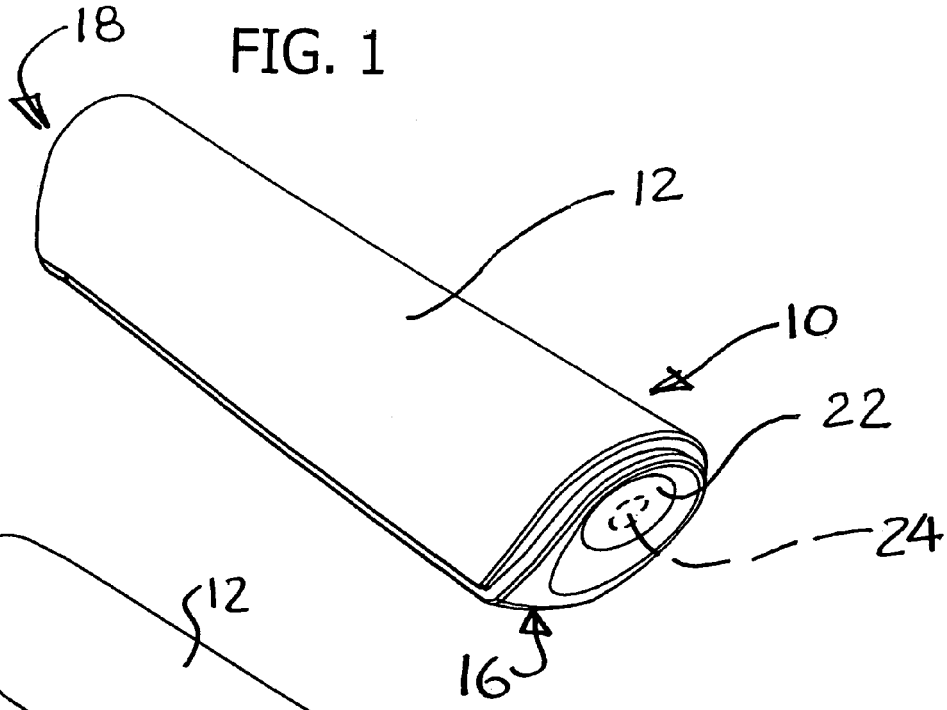
FIG. 1 is a front and top perspective view of a flashlight having touch sensing on/off operation.
Figure 2:
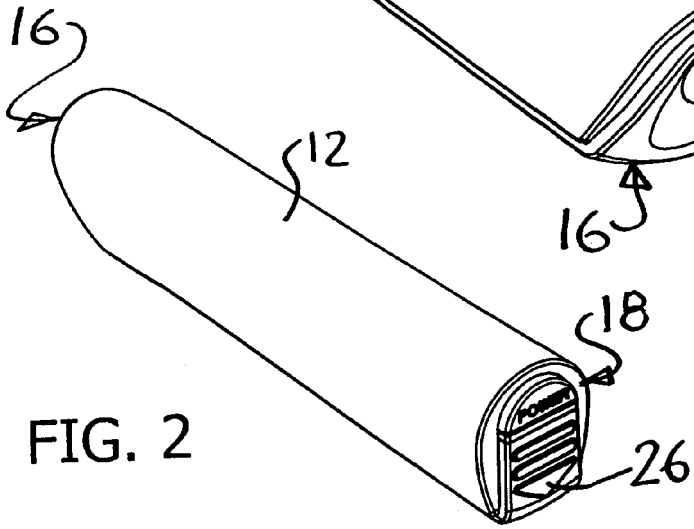
FIG. 2 is a back and top perspective view of the flashlight shown in FIG. 1.
Figure 3:
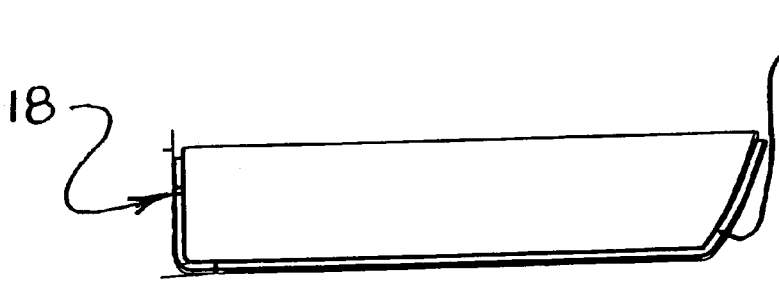
FIG. 3 is a side view of the flashlight shown in FIG. 1.
Figure 4:
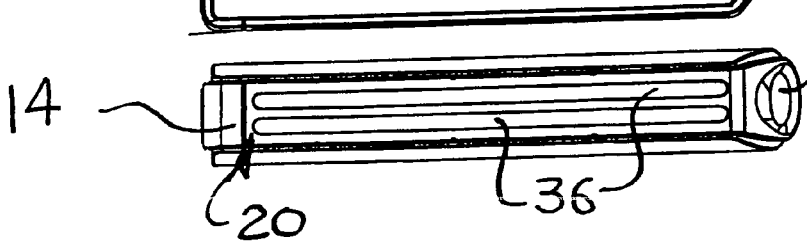
FIG. 4 is bottom view of the flashlight shown in FIG. 1.

The invention relates to hand-held devices or appliances that are electrically powered. As used here, the word device includes all hand-held articles that are portable and are electrically powered via self contained power sources (which typically are batteries). The devices may or may not have a moving element, such as a fan blade, or the tip of a massager. The devices may have display screens and sound speakers, such as a cell phone, PDA, video game, etc. and they may also have vibrating elements, such as a pager or a massager.

As shown in FIGS. 1-4, an appliance or device, and in this specific embodiment, a flashlight 10, has a body or housing 12. A light source 24, such as an LED or incandescent bulb, and optionally a lens 22, are at a front end 16 of the housing 12. A door or cover 26 may be provided at the back end 18. The door 26 may be opened to access a battery compartment, to change the batteries. The flashlight advantageously may have a flat bottom surface 20. The bottom surface 20 may be formed as part of the housing 12, or as shown in the Figures, a base 14 may form the bottom surface 20.

Figure 5:
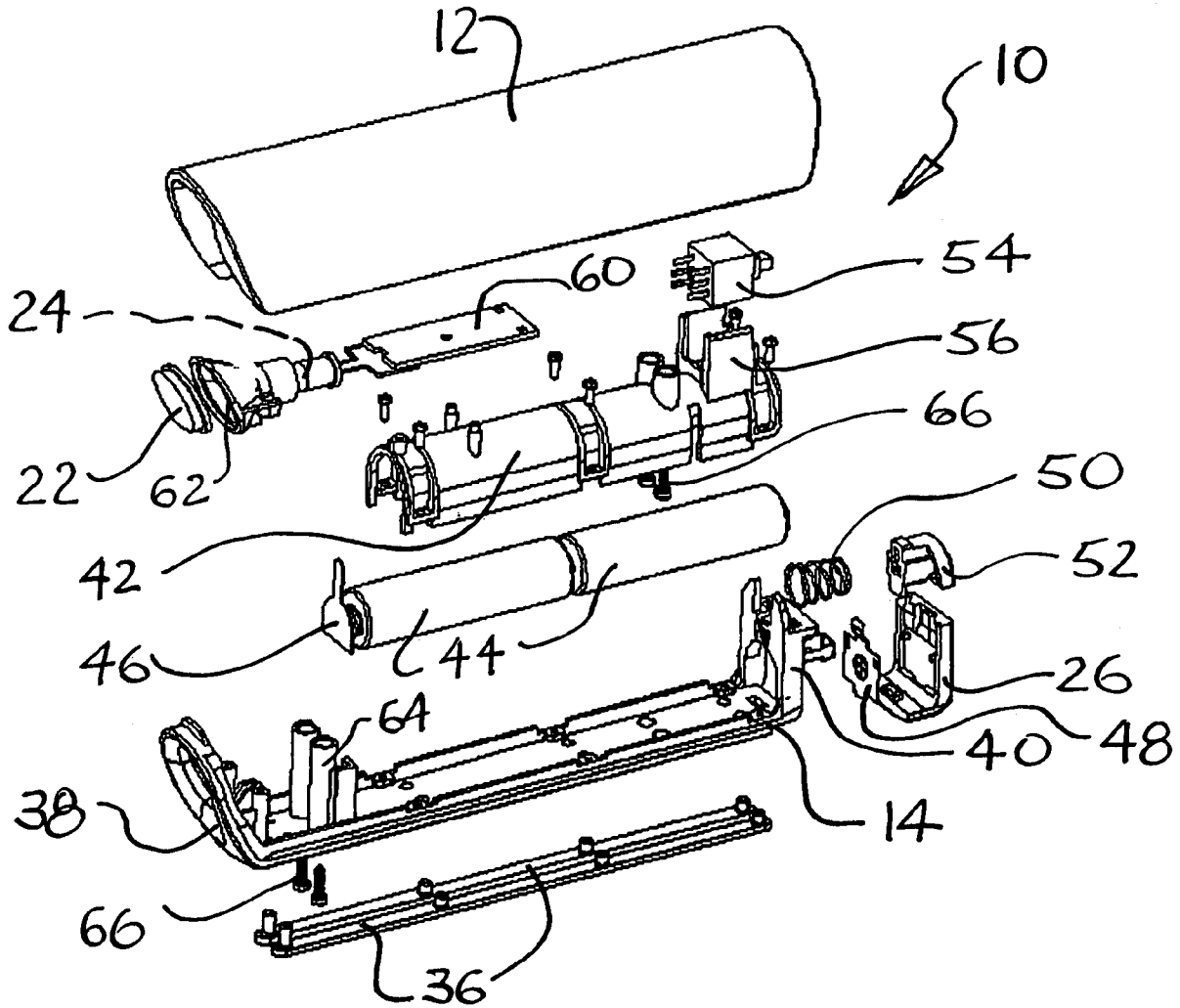
FIG. 5 is an exploded perspective view of the flashlight shown in FIG. 1.

Referring now also to FIG. 5, in the design shown, a separate base 14 is used. First and second contact bars or strips 36 are located on the bottom or outside facing surface of the base 14. The contact bars 36 may be generally parallel to each other, as well as parallel to a central axis of the generally cylindrical housing 12. If used, the base 14 may have an upward angled or extending front plate 38 and a rear plate 40. Then the front plate 38 may surround or be adjacent to the lens 22, and the door 26 can be supported on the back plate 40. A reflector 62 may optionally be provided around the light source 24. One or more batteries 44 can be placed in a battery compartment or space, formed between the base 14 and a battery cover or frame 42.

A mechanical micro-switch 54 can be supported in a switch holder 56 on the battery cover 42, actuated by a push button 52 biased outwardly by a spring 50. Front and back end battery contacts 46 and 48 make electrical connections to the batteries. A circuit board 60, if used, can be attached onto posts on the battery cover 42. The base 14 and housing 12 may be attached together via screws 66 in stand offs 64, as shown in FIG. 5. The specifics of the part selections, placement and mechanical attachment are not critical and can of course be varied, within the scope of the invention.

Figure 6:
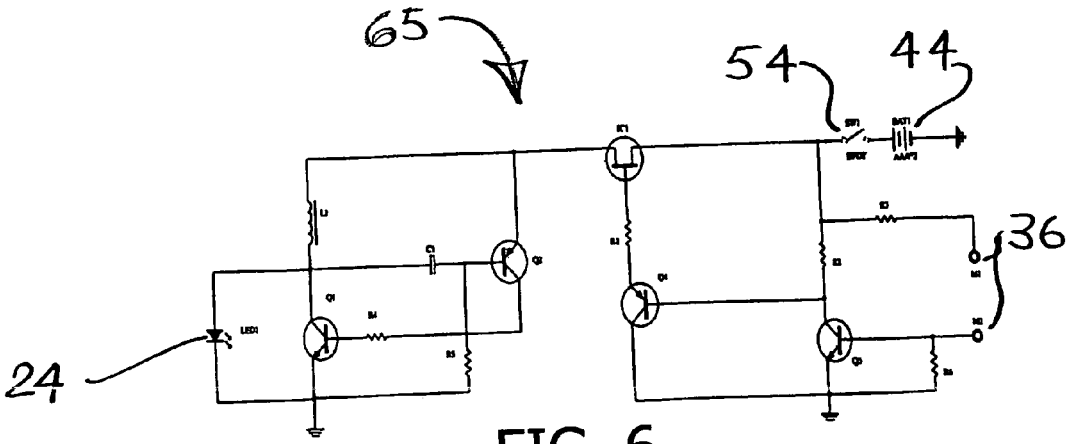
FIG. 6 is a schematic diagram of a circuit for use in the flashlight shown in FIG. 1.

FIG. 6 shows the electrical connections and circuit 65 of the flashlight 10. The positive side of the batteries 44 connects to the on/off switch 54. The touch or contact bars 36, which may be carbon contact bars, are connected across resistor R2 and transistor Q5, with further connections as shown between the other components, discrete or integrated. The light source or LED 24 is connected across Q1. Again, the design specifics of the circuit and electrical connections are not critical, so long as the automatic touch/turn function is provided.

In use, with the switch 54 in the off position, the flashlight remains off at all times, and battery power is conserved. With the switch 54 in the on position, the contacts 36 ordinarily act as an open switch. In this condition, the circuit 65 does not supply current to the LED 24. When the flashlight is grasped or picked up, the user's hand bridges the contact bars 36. The contact bars then act as a closed switch. The circuit 65 is switched on and current is provided to the LED 24. This continues until the flashlight is released by the user.

The flashlight 10 may include the housing 12, the base 14, or both in the design shown. The word "housing element" designates a housing, or a base, or a combination of a housing and a base. The contacts or contact bars 36 are on, or extend through to, an outside surface of the housing or the base, if used. The housing and/or base are typically made of plastic or metal, and are substantially rigid and incompressible, at least in ordinary use. The contact bars provide for touch detection, preferably without substantial deflection or movement. The contact bars remain stationary at all times, even when the flashlight is grasped or held in the hand of a user. The shape of flashlight therefore remains constant at all times, providing a secure feel in the user's hand. Squeezing the flashlight, to deform its shape, is not necessary (or possible) for turning on the light, since the contacts operate electrically and not mechanically. The contact bars may not necessarily provide any noticeable tactile feel to the user at all. In other words, the contact elements, and the flashlight or other device itself, is rigid and does not deform when picked up and handled in ordinary use. Although shown in FIG. 5 as separate elements, the contact bars 36 may be made integral with a base 14, or with a housing 12. Accordingly, the contact bars 36, as well as the other contact elements described below, may not be, and need not be, visible as separate elements on the housing. Rather, they may be designed merely as areas of a housing.

Other forms of the contact bars 36 may of course also be used, to sense touch. These include other electrical conduction or continuity elements, such as contact points or arrays, inductive or capacitive change sensors, pressure sensitive elements, heat sensitive elements, optical devices, and other devices that sense touch without any mechanical movement by or within the device.

Figure 7:
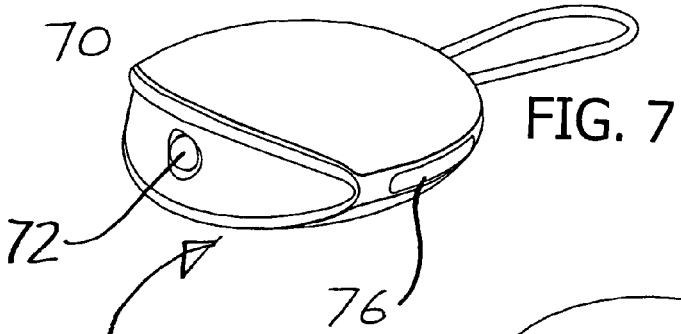
FIG. 7 is a front, top and right side perspective view of a keychain light having touch sensing on/off operation.
Figure 8:
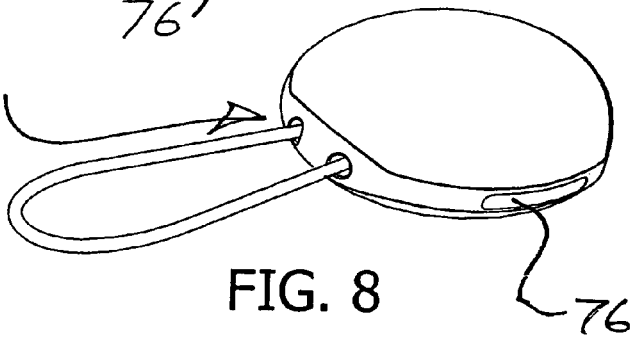
FIG. 8 is a back, top and left side perspective view of the keychain light shown in FIG. 7.

FIGS. 7 and 8 show a keychain light 70 also having a touch/on feature. The keychain light 70 has a light source or LED 24 on a body or housing 74. Touch or contact bars, strips or sensors 76 are located on opposite sides of the housing 74. The contact bars 76 operate in a way similar to the contact bars 36 shown in FIG. 5. When the keychain light 70 is picked up, the LED 24 turns on, as explained above in connection with the flashlight 10.

Figure 9:
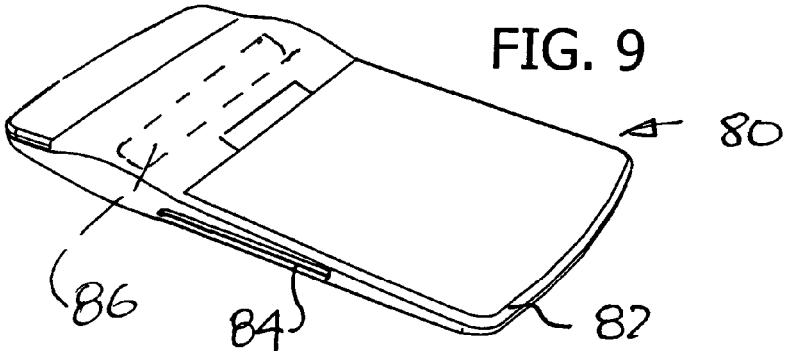
FIG. 9 is a bottom, front and left side perspective view of a compact having a mirror light with touch sensing on/off operation.
Figure 10:
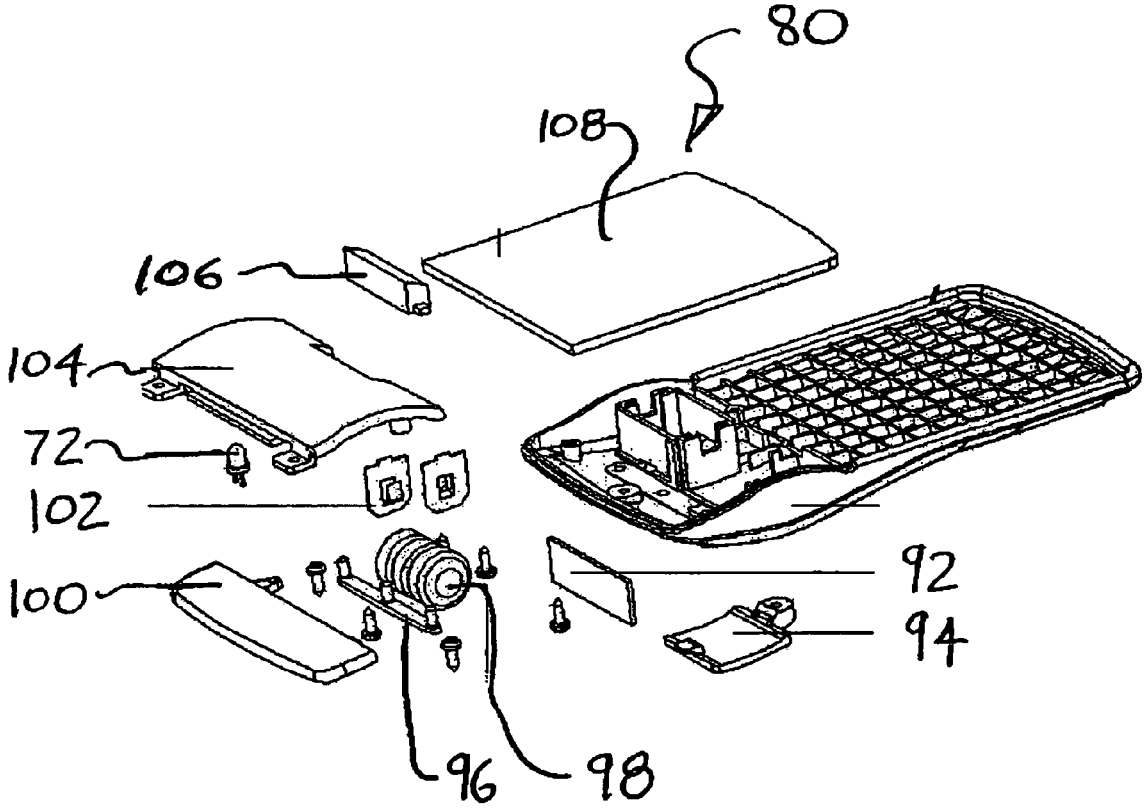
FIG. 10 is an exploded perspective view of the mirror light shown in FIG. 9.
Figure 11:
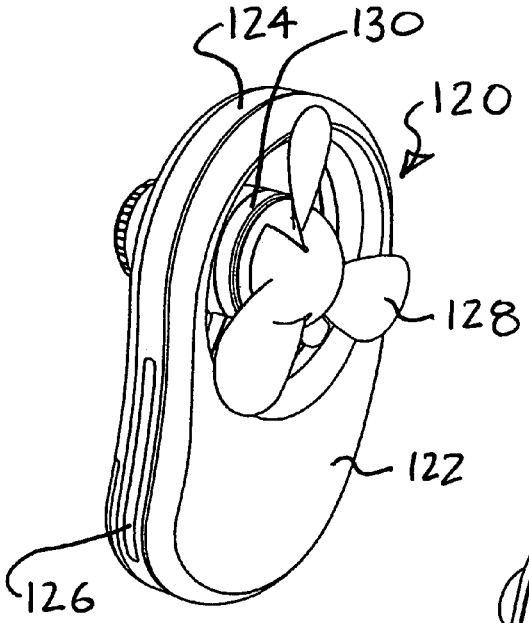
FIG. 11 is a front and left side perspective view of a fan having touch sensing on/off operation.
Figure 12:
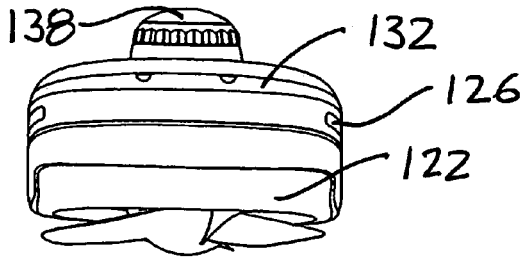
FIG. 12 is a top perspective view of the fan shown in FIG. 11.

FIGS. 9 and 10 show a touch light mirror 80 also having a touch/on feature as described above. The touch light mirror 80 may have contact strips on opposite sides of a case 82 as shown in FIGS. 9 and 10. Alternatively, a lower contact strip 96 and an upper contact plate 100 can be used, as shown in FIG. 10. A mirror 108 is attached to the case 82. Batteries 98 are held in a battery compartment closed off by a door 94. A circuit board 92 is connected to the batteries 98 by battery contacts 102, and to an LED 72. A front or top cover 104 and a lens 106 are also attached to the case.

When the case is picked up, and the user's hand touches the contact strips, a light or LED 86 in or on the case turns on. The touch light mirror 80 may have one or more flip open covers 88. If so, the circuit 65 used in the touch light mirror may also be designed so that the light 86 remains off until a cover is opened.

As shown in FIGS. 7-10, the invention relates to other devices having a light source, in addition to flashlights. The term flashlight, as used here, means these other types of devices as well.

Figure 13:
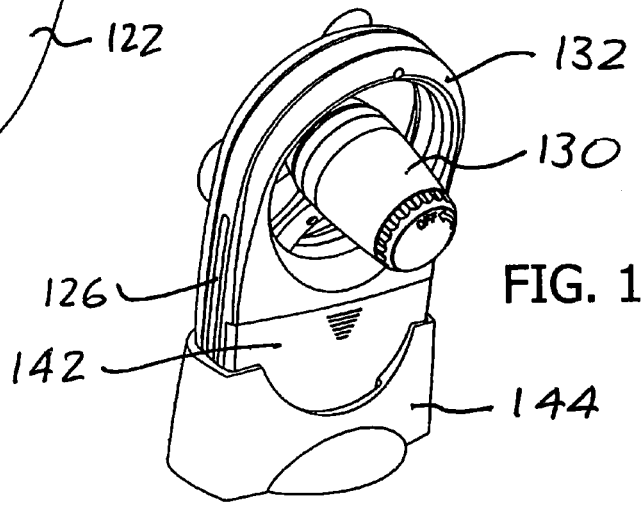
FIG. 13 is a back, top and right side perspective view of the fan shown in FIGS. 11 and 12, with the fan supported in a holder.
Figure 14:
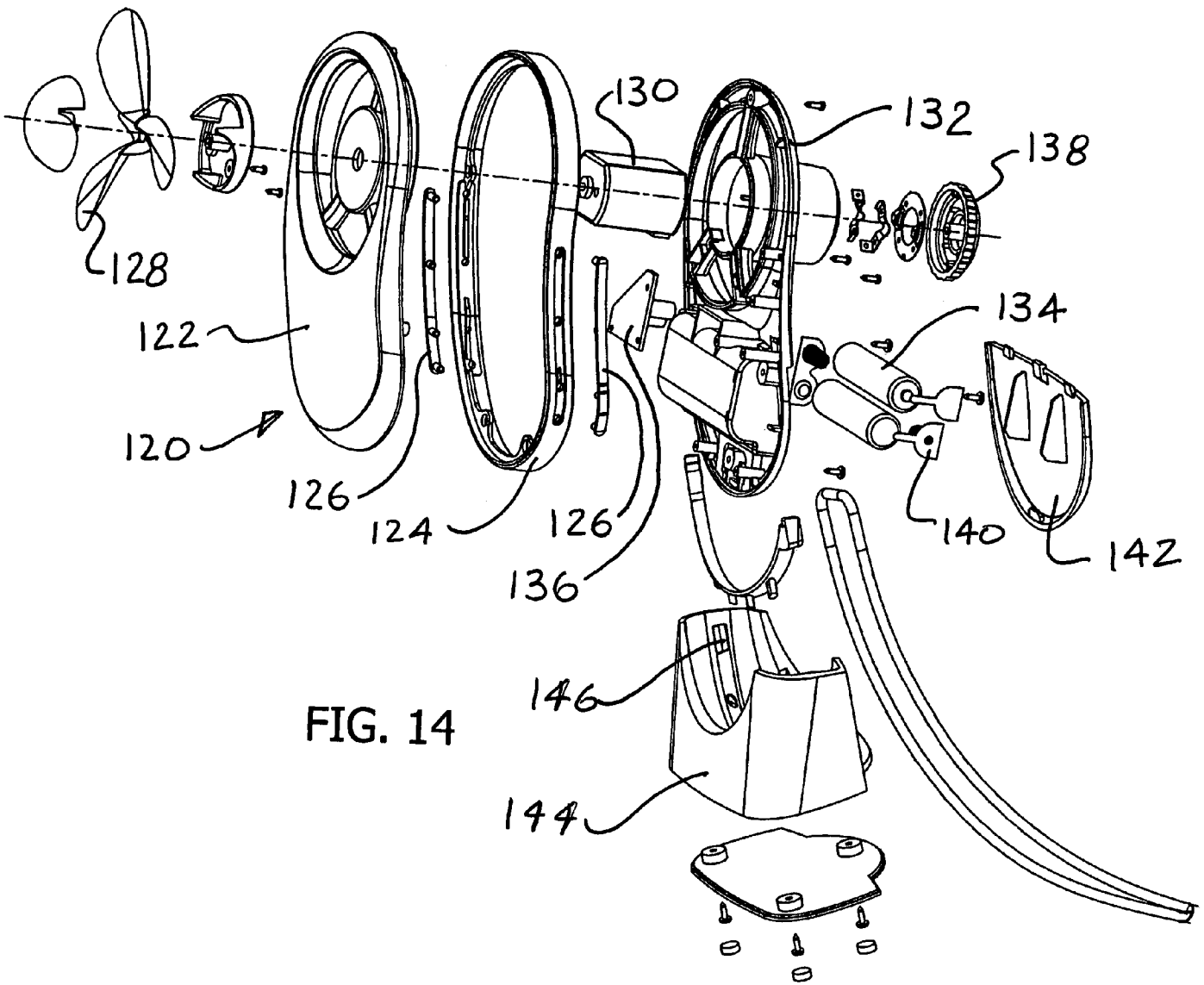
FIG. 14 is an exploded perspective view of the fan shown in FIGS. 11-13.
Figure 15:
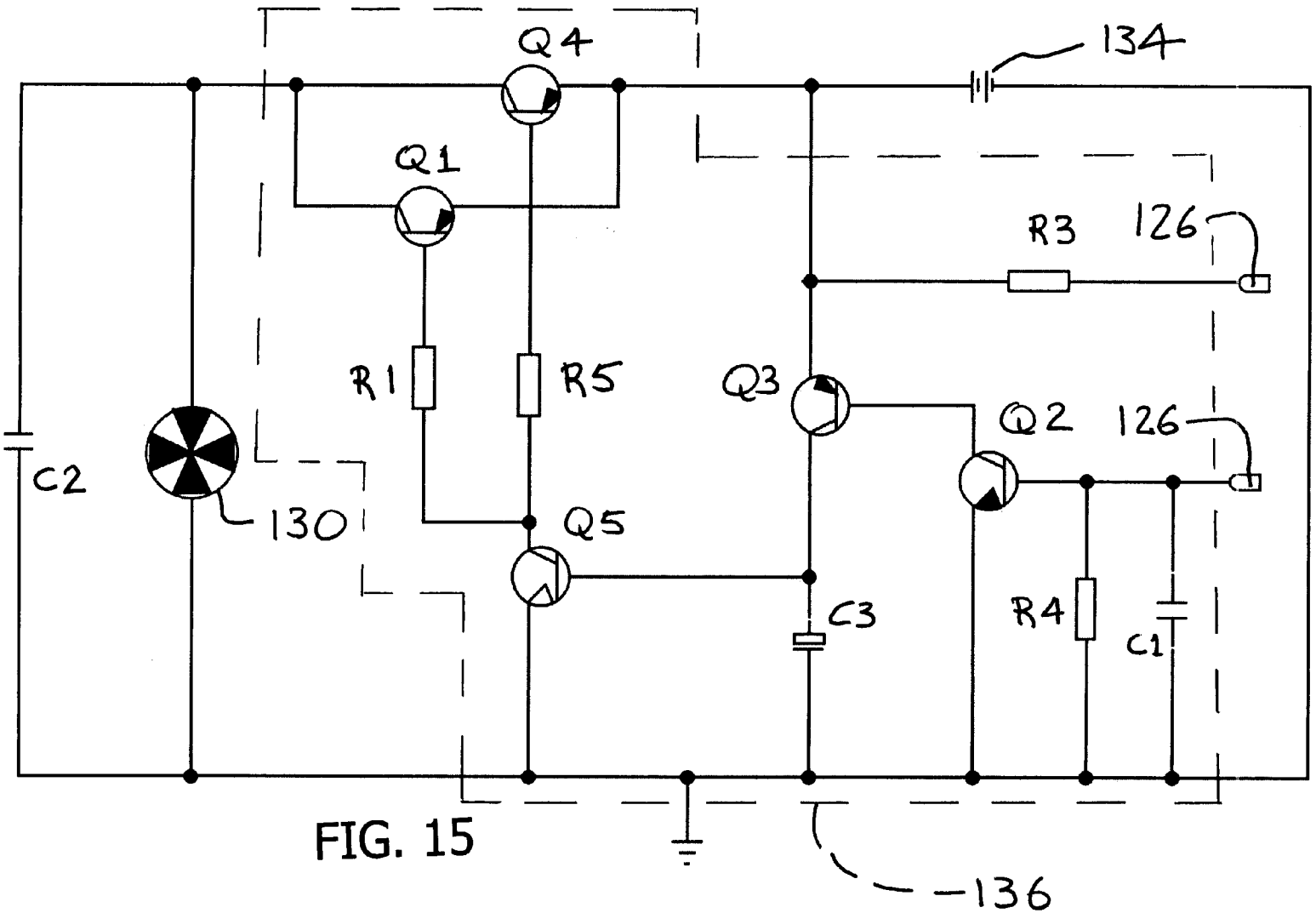
FIG. 15 is a schematic diagram of a circuit for use in the fan shown in FIGS. 11-14.

Turning to FIGS. 11-15, a portable or hand-held fan 120 has a front plate 122 attached to a contact ring 124 which in turn is attached to a rear housing 132. As best shown in FIG. 14, a propeller 128 is driven by an electric motor 130 supported on the rear housing 132. Batteries 134 are contained in a battery compartment on the rear housing 132 closed off by a battery cover plate 142. Referring to FIGS. 14 and 15, a circuit board 136 includes circuitry for controlling and driving the motor 130. Contact strips 126, which may be carbon, and an optional on/off switch 138, are electrically linked to the circuit board. Electrical power is provided to the motor 130 from the batteries 134 through battery contacts 140 and leads to the circuit board 136.

Operation of the fan 120 is similar to the other devices described above. When the fan 120 is picked up, the user's hand makes contact with the contact strips 126. This switches on the transistors shown in FIG. 15 allowing current from the batteries 134 to flow to and drive the motor 130. The contacts 126 act as poles of a switch, with the user's hands acting to close the switch. The current flow across the contacts 126 is negligible and not noticeable to the user, primarily due to R3. The contacts 126 are advantageously fixed in place on the contact ring 124, do not or need not move appreciably when grasped by the user, and by themselves (i.e., without the user's hand or other element(s)) do not form a switch. If an on/off switch 138 is included, the fan 120 can be switched on, and can remain on, bypassing the contact strips 126. The on/off switch 138, if included, can open or close an electrical connection between R3 and the base of Q2 in FIG. 15, allowing the fan 120 to operate as a conventional fan having an on/off switch. In this way, the fan can be turned on, and remain on, without the need for the user's hand to touch the contacts 126.

As shown in FIGS. 13 and 14, the fan 120 may be placed in a stand 144. The stand 144 may include a stand contact or conductor 146 adapted to engage both of the contacts strips 126 on the fan 120. Consequently, when the fan is placed into the stand 144, the contact strips 126 are bridged, and fan will turn on, or stay on, while in the stand.

Figure 17:
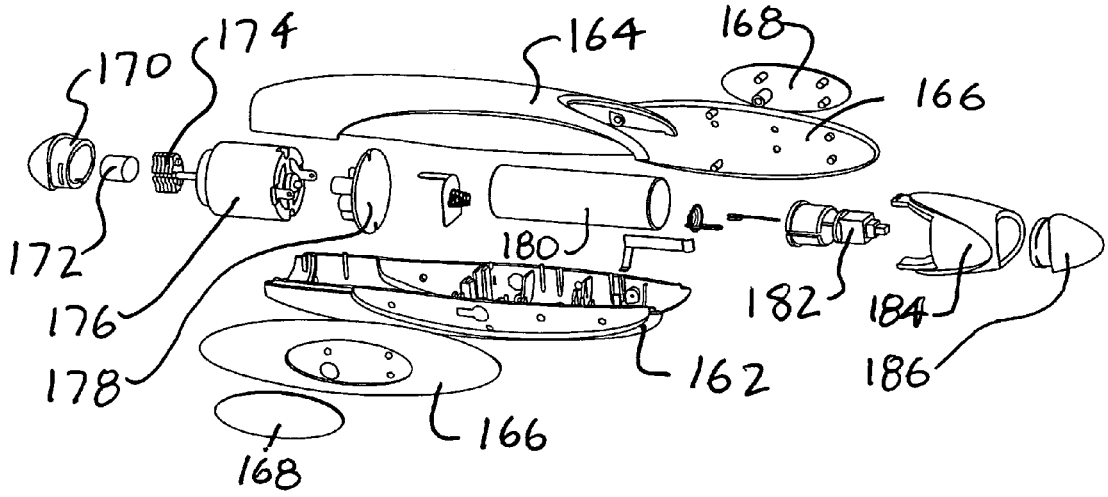
FIG. 17 is an exploded perspective view of the massager shown in FIG. 16.
Figure 16:
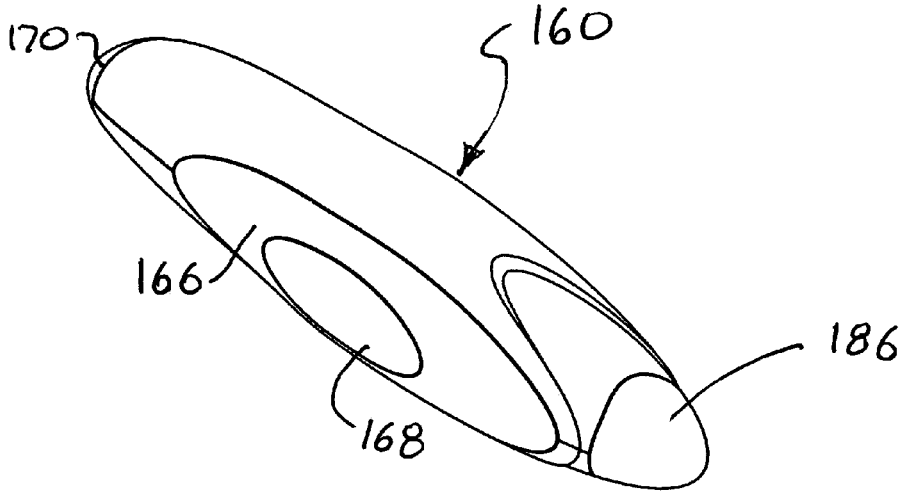
FIG. 16 is a perspective view of a massager having touch sensing on/off operation.

FIGS. 16 and 17 show a massager device 160 also having touch on/off operation. The massager 160 typically has a lower housing 162 attached to an upper housing 164, and may also include decorative side covers 166. Contact bars 168, similar to the contact strips described above, are attached to the side covers 166 and/or to one or both of the housings 162 and 164. A motor 176, a circuit board 178, and one or more batteries 180 along with battery contacts are contained within and supported by one or both of the housings. A vibrator 174 is attached to the shaft of the motor 176. A magnet 172 extends into a front cap 170, which is supported on one or both of the housings. A battery cover 184 and an end cap 186 close off the back end of the massager 160. An on/off switch 182 may also optionally be included. If used, the switch 182 is actuated by pressing in on the end cap 186.

Operation of the massager 160 is similar to the devices described above. When the massager 160 is picked up, a small amount of current flows between the contact bars 168, via the user's hand, causing the motor to turn on. The front cap 170, which is preferably metal, vibrates to provide a massaging action. The on/off switch 182 may be provided to allow the massager to be switched on and off for conventional operation.

Figure 19:
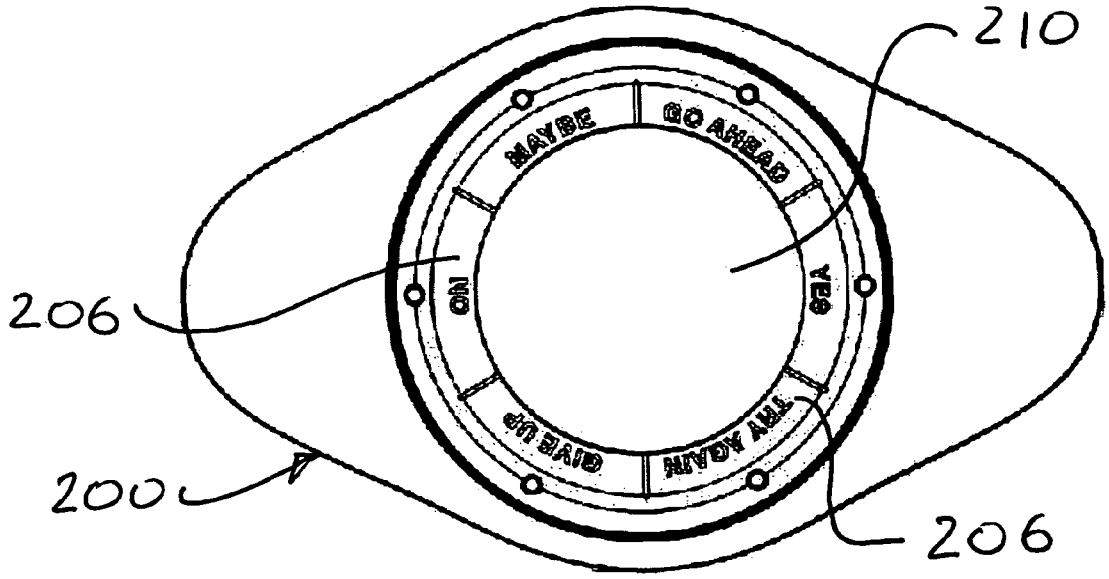
FIG. 19 is top view of the decision maker shown in FIG. 18.
Figure 18:
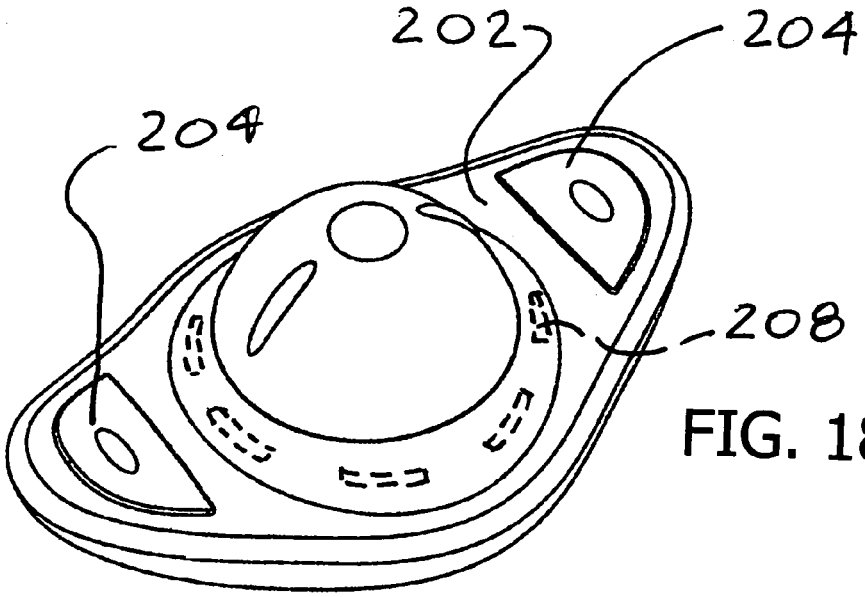
FIG. 18 is a bottom perspective view of a decision maker having touch sensing operation.

Another touch controlled device, in the form of a decision maker 200, is shown in FIGS. 18 and 19. The decision maker 200 is a novelty or entertainment device that provides random or pseudo-random answers to questions posed by the user, for amusement purposes. As shown in FIG. 18, the decision maker 200 has a housing containing one or more batteries, a circuit board, and lighting elements 208, such as LEDs, similar to the other lighted devices described above. Contact pads 204 are provided on the bottom of the housing 202, as shown in FIG. 18. Decision segments 206 are provided on the top of the housing 22, as shown in FIG. 19. The decision segments have printed, engraved, or otherwise applied answers, such as YES, NO, MAYBE, etc. When the decision maker is picked up, the user's hands make contact with the contact pads, causing a lighting element 208 associated with one of the decision segments to light up. The illuminated decision segment then indicates the decision maker's answer to the user's question. The decision maker 200 may optionally be provided with a speaker and voice circuitry, to allow answers to be spoken as well. A window 210 within the decision segments may also be provided, to allow viewing into the hemispherical center section of the housing 202. Additional lighting elements may be provided to selectively illuminate the interior of the center section. An object, such as a suspended or floating geometric object, or other entertainment piece, may be placed into the center section of the housing. The object can be become visible through the window, when illuminated, to provide additional entertainment.

Various changes and substitutions can of course be made to the devices described above, without departing from the spirit and scope of the invention. The invention, therefore, should not be limited, except by the following claims, and their equivalents.

The invention claimed is:

1. A hand-held electrically powered appliance, comprising:
   - a housing;
   - one or more batteries in the housing;
   - a control circuit in the housing;
   - an electrical load element on or in the housing;
   - first and second hand contact sensors fixed in place on outside surfaces of the housing, with the contact sensors, and the batteries, and the load element, linked to the control circuit, and with the control circuit providing electrical power to the load element when a conductive path is made between the first and second contact sensors; and
   - with the first and second hand contact sensors on opposite sides of the housing.

2. The appliance of claim 1 wherein the electrical load element comprises one or more LED's.

3. The appliance of claim 2 wherein the housing is substantially rigid and wherein the contact sensors are immovable relative to the housing.

4. The appliance of claim 1 wherein the electrical load element comprises a motor.

5. The appliance of claim 1 further comprising an on/off switch linked to the control circuit.

6. The appliance of claim 1 wherein electrical conduction between the first and second contact sensors causes transistors or switches in the control circuit to deliver power from the batteries to the load element.

7. The appliance of claim 1 wherein the first and second contact sensors comprise elongated contact bars.

8. The appliance of claim 1 with the load element comprising one or more LED's and further comprising a keychain loop attached to the housing, and with the appliance comprising a keychain light.

9. The appliance of claim 1 with the load element comprising one or more LED's and further comprising a mirror attached to the housing, and with the appliance comprising a lighted mirror.

10. The appliance of claim 1 with the load element comprising a fan motor and further comprising a fan blade attached to the fan motor, and with the appliance comprising a portable fan.

11. The appliance of claim 1 with the load element comprising a motor and further comprising a vibrator attached to the motor and with the appliance comprising a handheld massager.

12. A hand-held electrically powered appliance, comprising:
   - a substantially rigid housing;
   - one or more batteries in the housing;
   - an electrical load element on or in the housing;
   - first and second hand contact sensors fixed in place on opposite outside surfaces of the housing, and with the first and second hand contact sensors immovable relative to the housing; and
   - control means for providing electrical power to the load element when a conductive path is made between the first and second contact sensors.

13. The appliance of claim 12 wherein the control means comprises a circuit having at least a first switch actuated by current flow between the first and second hand contact sensors, and at least a second switch actuated by the first switch, to provide power to the load element.

14. The appliance of claim 12 wherein the first and second switches comprise first and second transistors, respectively.

15. The appliance of claim 14 wherein the electrical load element comprises a motor.

16. A hand-held electrically powered appliance, comprising:
   - a substantially rigid housing;
   - one or more batteries in the housing;
   - an electrical load element on or in the housing;
   - first and second hand elongated contact sensors fixed in place on opposite outside surfaces of the housing, and substantially immovable relative to the housing; and
   - an electronic circuit within the housing and linked to the batteries, the electrical load element and the contact sensors, with the electronic circuit having at least a first switch actuated by current flow between the first and second hand contact sensors, and at least a second switch actuated by the first switch, to provide power to the load element.

17. The appliance of claim 16 wherein the load element comprises one or more LED's and the appliance comprises a flashlight.

18. The appliance of claim 16 wherein the housing has a longitudinal axis and the elongated contact sensors are substantially parallel to each other and to the longitudinal axis.

* * * * *